US005890889A

United States Patent [19]

Barstow

[11] Patent Number: 5,890,889

[45] Date of Patent: Apr. 6, 1999

[54] SHAFT FURNACE

[75] Inventor: Richard A. Barstow, Addison, Ill.

[73] Assignee: Cyprus Amax Minerals Company, Englewood, Colo.

[21] Appl. No.: 727,255

[22] Filed: Oct. 8, 1996

[51] Int. Cl.[6] ..... F27D 1/08; C21C 5/48

[52] U.S. Cl. ..... 432/99; 266/900; 266/197; 266/219; 432/96

[58] Field of Search ..... 266/197, 214, 266/219, 900; 432/95, 96, 99

[56] References Cited

PUBLICATIONS

A.K. Biswas, et al., *Extractive Metallurgy of Copper,* vol. 20 of the Internat'l Series on Materials Science and Tech. (Pergamon Int'l Library); Editor: D.W. Hopkins, M.Sc.; Pergamon Press Ltd.; 1st ed.; 1976, pp. 336–345.

*Primary Examiner*—Teresa J. Walberg
*Assistant Examiner*—Gregory Wilson
*Attorney, Agent, or Firm*—Klaas, Law, O'Meara & Malkin, P.C.; Bruce E. Dahl, Esq.

[57] ABSTRACT

An improved hearth section for a shaft furnace may comprise a plurality of splines mounted to the side wall of the hearth section in spaced-apart circumferential positions so that each of the splines extends radially inward from the side-wall and into the interior of the hearth section. The floor of the hearth section may include a plurality of stand-offs positioned in generally spaced-apart relation and that extend upward from the floor and into the interior of the hearth section.

27 Claims, 4 Drawing Sheets

SHAFT FURNACE

FIELD OF INVENTION

This invention relates to metals processing in general and more specifically to shaft furnaces for the melting and casting of copper.

BACKGROUND

Shaft furnaces have been used for decades in a wide variety of applications from smelting, to the manufacture of steel, to the melting of various metals in preparation for the casting of the same. Generally speaking, most shaft furnaces comprise an elongate, generally cylindrically-shaped structure having a cylindrical bottom portion or hearth from which rises a generally conically tapered portion, often referred to as the bosh. The bosh is surmounted by a taller tapered structure or stack. Depending on the application, the hearth of the shaft furnace may also include several rows of radially oriented burners and/or tuyeres to provide heat and/or air for the smelting reaction and/or melting of the material contained within the furnace. The furnace may be provided with one or more tap holes for drawing off molten material and/or slag contained within the furnace, again depending on the application. Since the interior of the shaft furnace is subjected to extreme temperatures during operation, the furnace is lined with various types of refractory materials, generally in the form of bricks, suitable for withstanding the extreme operating temperatures of the furnace, as well as the chemical composition of the materials contained therein.

Shaft furnaces may also be specifically adapted for the melting of metals in preparation for the casting of the same. For example, a shaft furnace 11 suitable for the melting of copper so that the same may be cast into wirebars or continuous bar stock is shown in FIG. 1. Essentially, the shaft furnace 11 may comprise an elongate generally conically shaped hearth section 13 having a plurality of radially oriented burners 15 therein. The lower end or floor 17 of the hearth section 13 terminates in a tap hole 19. The upper end 21 of the hearth section 13 terminates in a generally cylindrically shaped intermediate section or bosh 23, which itself is surmounted by a charging section 25 and a stack section 27. The metal charge to be melted, e.g., copper cathode 29, may be fed into the furnace 11 via an opening 31 in the charging section 25 by a suitable charging system (not shown). The copper cathode charge 29 is heated and melted by ascending combustion gases 33 produced by the burners 15 as it descends through the intermediate section or bosh 23 and into the hearth section 13. Liquid copper accumulates on the floor 17 of the hearth section 13 and is drawn-off through the tap hole 19. Generally speaking, not all of the copper is melted as it descends through the furnace and partially melted cathodes 29 may accumulate in the hearth section 13 until they melt completely.

The shaft furnace 11 is essentially a counter-current heat exchanger, with the descending copper charge being rapidly and efficiently heated by the ascending combustion gases 33. Moreover, the shaft furnace 11 is primarily a melting device and does not remove impurities from the copper charge. Consequently, the cast copper is generally of the same purity as the cathode feed.

Shaft furnaces of the type shown in FIG. 1 and described above include several features to maintain the purity of the molten metal and to ensure efficient operation. For example, it is important that the combustion gases 33 from the burners not degrade the quality of the copper. Consequently, the burners 15 and combustion gases 33 must be such that the copper charge 29 is not oxidized during melting. This may be achieved by using the so-called premix tunnel burners in which the combustion process is completed within the burner port to ensure that unconsumed oxygen does not enter the furnace. It is also important that the fuel be substantially free of sulfur to avoid contamination of the copper charge 29. Commonly used fuels include sulfur-free natural gas, propane, methane, butane, and naphtha.

Quite often, the interior of the hearth section 13 is tapered as shown in FIG. 1 to slow the fall of the copper cathode and to ensure that the molten copper leaves the furnace at a temperature sufficiently high to minimize the chance that it will re-freeze within the tap hole 19. The maximum inside diameter of the furnace 11 and hearth section 13 may also be limited, again with the intention of providing sufficiently hot molten copper.

While shaft furnaces, such as the shaft furnace 11 shown in FIG. 1, have been used for decades and are generally relatively efficient in melting the copper charge, they are not without their problems. For example, there remains a tendency for some of the copper to exit the furnace at a temperature that is insufficient to prevent the copper from re-freezing within the tap hole and plugging the same. This tends to happen even with those furnaces with tapered hearth sections. Quite obviously, the re-freezing of the molten copper within and about the tap hole is inconvenient and may require that the furnace be shut down in order to unplug the tap hole.

Another problem associated with conventional shaft furnaces is that there is a tendency for pieces of solid copper to lodge against the burner throats. If this happens, the copper may increase the back pressure on the burner, which can adversely affect burner performance. If the problem is severe, it may even result in excessive amounts of un-burned oxygen being released into the furnace which, of course, can seriously degrade the quality of the cast copper product. Occasionally a piece of solid copper may actually plug the burner outlet, which may require a complete shut-down of the furnace in order to clear the plugged burner. While the foregoing problems may occur at any time during furnace operation, they are particularly prone to occur during furnace start-up.

Consequently, a need exists for an improved furnace that significantly reduces or eliminates the chances for the metal charge to re-freeze in and around the tap hole during the melting process. Ideally, such an improved furnace would also reduce or eliminate the likelihood for pieces of the metal charge to partially block or plug the burner outlets. Additional advantages could be realized if such a furnace would operate with increased efficiency.

SUMMARY OF THE INVENTION

An improved hearth section for a shaft furnace may comprise a plurality of splines mounted to the side wall of the hearth section in spaced-apart circumferential positions so that each of the splines extends radially inward from the side-wall and into the interior of the hearth section. The floor of the hearth section may include a plurality of stand-offs positioned in generally spaced-apart relation and that extend upward from the floor and into the interior of the hearth section.

Also disclosed is a method for melting a charge of material that may comprise the step of placing the charge of material into a shaft furnace. The furnace may include a hearth section having a plurality of splines mounted to the side-wall in generally spaced-apart relation so that each of the plurality of splines extends generally radially inward from the side-wall and into the chamber. The hearth section may also include a plurality of stand-offs mounted to the floor in generally spaced-apart relation so that each of the plurality of stand-offs extends generally upward from the floor and into the chamber. Hot combustion gases may then be introduced into the hearth section in an amount sufficient to melt the charge of material. Molten material may then be drawn off through a tap hole in the hearth section.

BRIEF DESCRIPTION OF THE DRAWINGS

Illustrative and presently preferred embodiments of the invention are shown in the accompanying drawings in which.

DETAILED DESCRIPTION OF THE INVENTION

Figure 2:
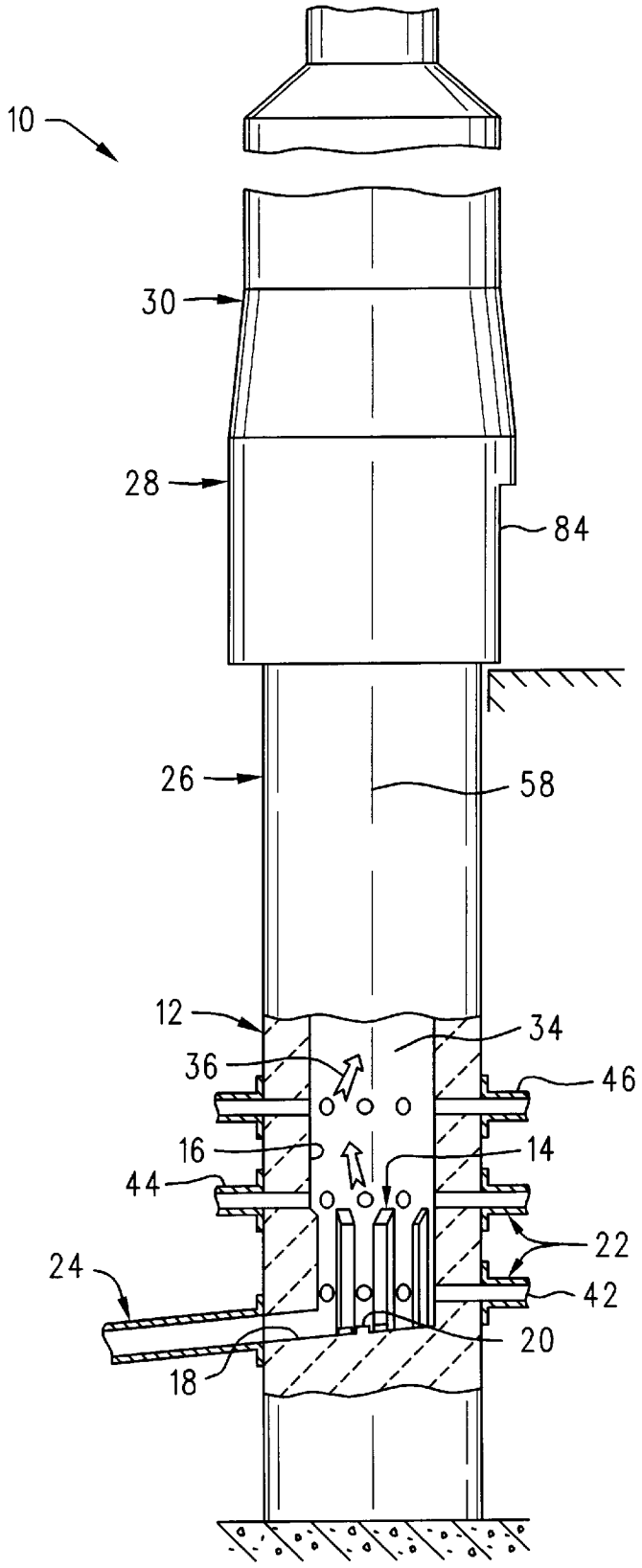
FIG. 2 is a side view in elevation of a shaft furnace according to the present invention with a portion of the hearth section broken away to show the splines and floor stand-offs.

An improved shaft furnace 10 according to the present invention is shown in FIG. 2 as it could be used for melting electrorefined or electrowon copper cathode. Essentially, the shaft furnace 10 may include a hearth section 12 that extends upward to an intermediate section or bosh 26. The bosh 26 is in turn surmounted by a charging section 28 and, ultimately, by a stack section 30. A plurality of burners 22 mounted to the hearth section 12 provide hot combustion gases 36 in quantities sufficient to melt the charge of material (not shown) contained within the furnace 10. A tap hole 24 extending through the hearth section 12 and adjacent the floor 18 may be used to draw-off molten copper (not shown) from the hearth section 12 for storage in a suitable holding furnace (not shown). With the exception of the special structural features associated with the hearth section, which will be described in detail below, the shaft furnace 10 may be of conventional construction. For example, in one preferred embodiment, the shaft furnace 10 may comprise one or two layers of refractory material, e.g., 16 and 54 (generally refractory brick), encased by a layer of concrete 52 and surrounded by a steel casing 50. However, other structural configurations are possible, as would be obvious to persons having ordinary skill in the art and as will be described in greater detail below.

Figure 3:
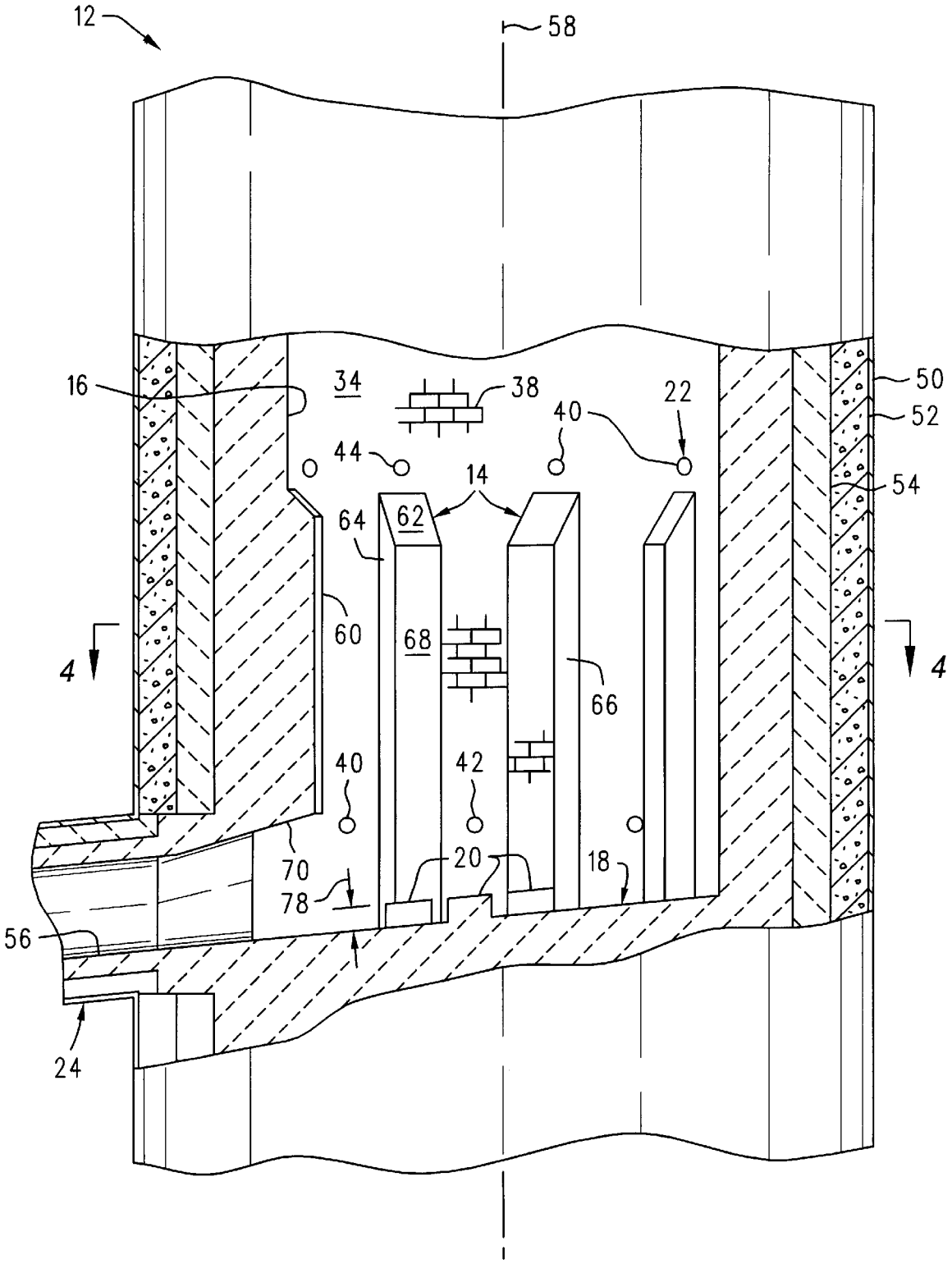
FIG. 3 is an enlarged cross-section view of the hearth section more clearly showing the splines and floor stand-offs.

Referring now to FIGS. 2 and 3, the hearth section 12 of the furnace 10 includes several features that are significant in achieving the objects of the present invention. More specifically, the hearth section 12 may include a plurality of splines 14 that are located at generally evenly spaced radial positions around the inner wall or side wall 16 of the hearth section 12. Each spline 14 extends into the hearth section 12 by a radial distance 72. See also FIG. 4. A special tap hole spline 60 may be positioned over the tap hole 24. As best seen in FIG. 3, each of the plurality of splines 14 is essentially identical and comprises a generally elongate, rectangularly shaped structure having a beveled top surface 62. The splines 14 help to prevent the solid pieces of material comprising the metal charge from contacting the inner wall 16 and from obstructing the burner outlets 40, as will be described in greater detail below.

Figure 1:
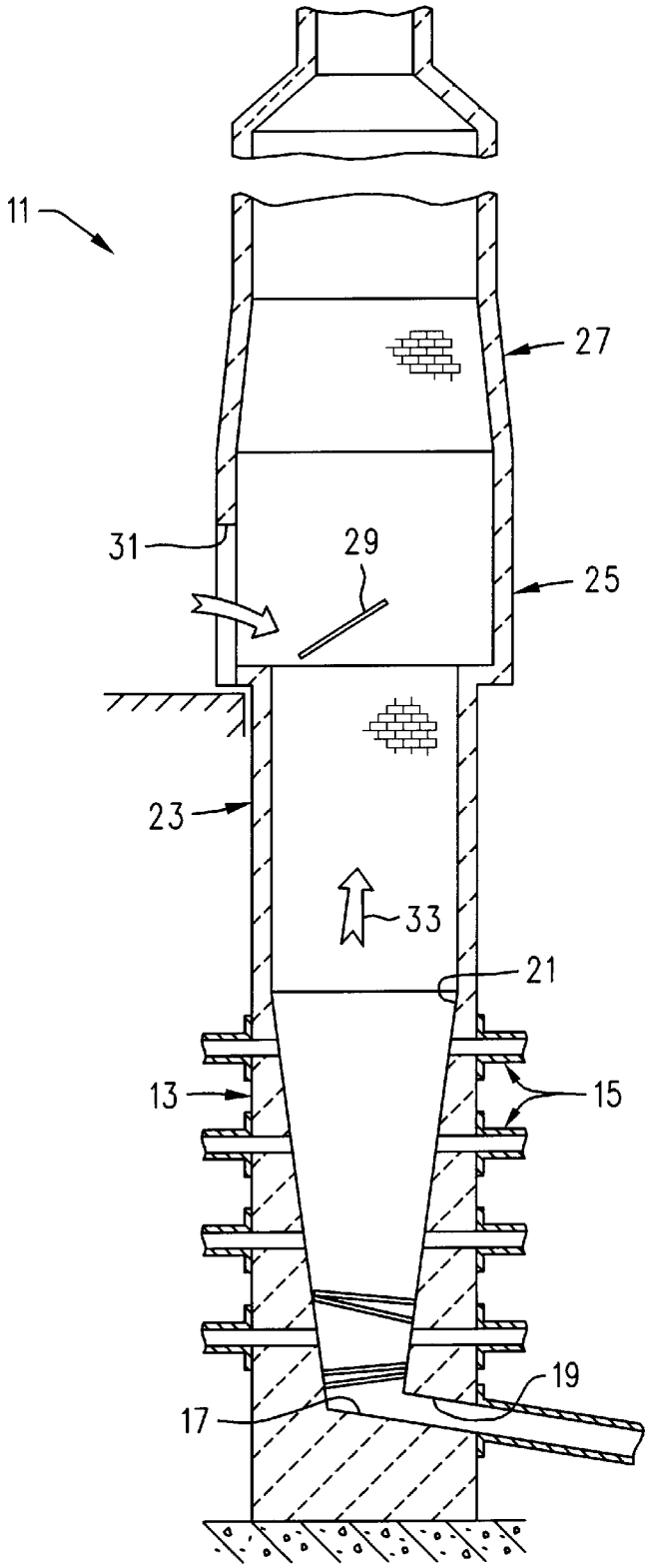
FIG. 1 (PRIOR ART)
FIG. 1 is a cross-section view in elevation of a typical prior art shaft furnace.

The overall shape of the hearth section 12 may take on different configurations depending on the particular application. For example, in one preferred embodiment, the inner wall 16 of the hearth section 12 may be generally vertical, so that the inner wall 16 defines a generally cylindrically shaped chamber 34. However, in another embodiment, the inner wall 16 may be tapered to define a generally conically shaped chamber, as best seen in FIG. 1. In any event, a plurality of splines 14 may be incorporated into the inner wall.

Figure 4:
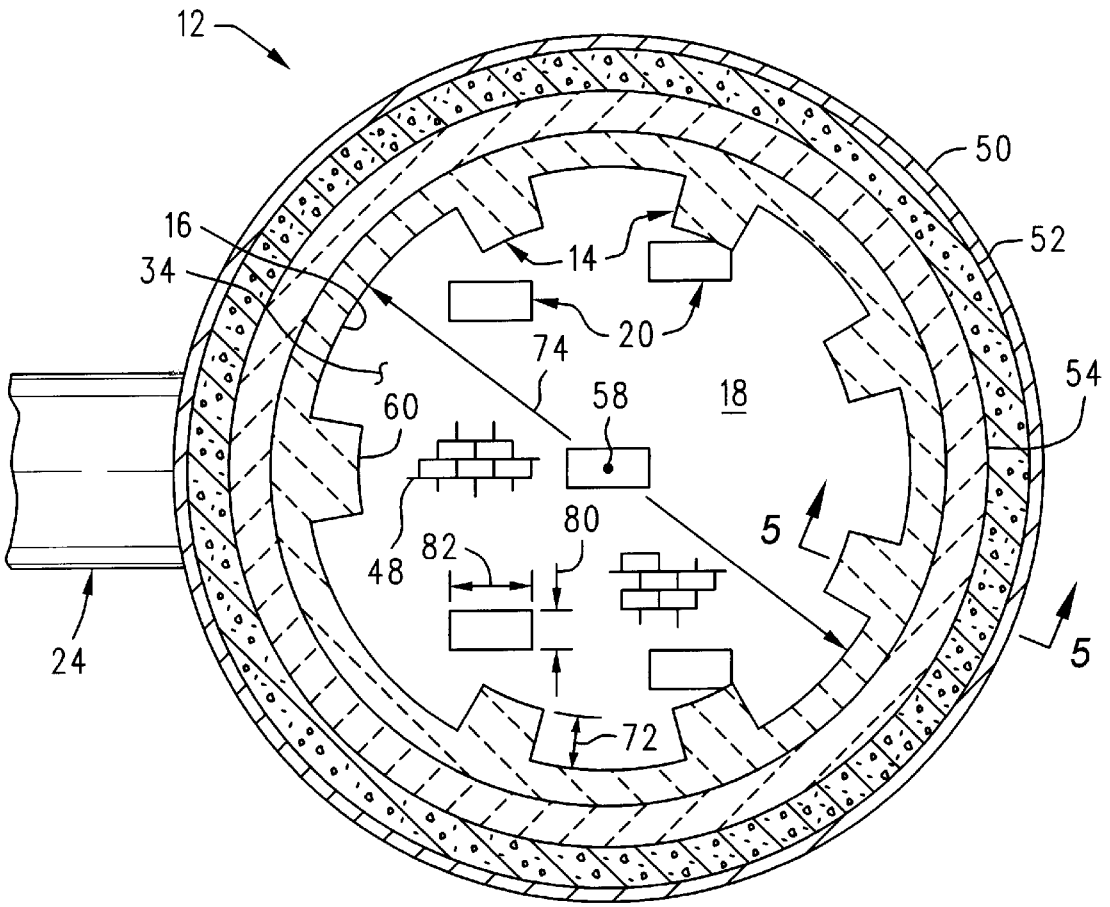
FIG. 4 is a cross-section view of the hearth section taken along the line 4—4 of FIG. 3.

The floor 18 of the hearth section 12 may include a plurality of stand-offs 20 arranged in spaced apart relation, as best seen in FIGS. 3 and 4. Briefly, each stand-off 20 may comprise a generally rectangularly shaped structure that extends upward from the floor 18 by a height 78. The stand-offs 20 help to prevent solid pieces of material from directly contacting the floor refractory brick 48.

If the shaft furnace 10 is used to melt electrorefined or electrowon copper cathode and/or reclaimed copper scrap, the furnace 10 may be operated as follows. As a first step, the interior of the furnace 10 may be charged with an appropriate quantity of copper cathode (not shown in FIG. 2, but shown generally in FIG. 1) via a charge opening 31 contained within the charging section 28. The charge material (e.g., copper cathode) will then fall through the intermediate section or bosh 26, ultimately settling within the hearth section 12. The splines 14 and stand-offs 20 mounted within the hearth section 12 help to prevent the solid copper charge material from contacting the inner wall 16 and floor 18 of the hearth section 12.

Once the furnace 10 has been charged, the burners 22 may be ignited. The hot combustion gases 36 from the burners 22 heat the copper charge (not shown) and the interior surfaces of the furnace 10, eventually increasing the temperature of the copper charge by an amount sufficient to change it from the solid state to the liquid state. The liquid copper (not shown) is then drawn-off through the tap hole 24, whereupon it may be stored in an induction or fuel fired holding furnace (not shown) in preparation for casting. The operation may be made continuous by continuing to feed copper cathode into the charging section 28 at a rate commensurate with the capacity of the furnace 10.

A significant advantage associated with the shaft furnace 10 according to the present invention is that the various splines 14 extending from the interior wall 16 of the hearth section 12 help to hold the solid pieces of material contained within the charge away from the inner wall 16. The separation of the solid pieces from the inner wall 16 allows the hot combustion gases 36 from the various burners 22 to more fully contact the refractory brick, e.g., 38, lining the inner wall 16, thereby allowing the refractory brick 38 to heat more rapidly, particularly during furnace start-up. The splines 14 also improve the uniformity of the temperature of the copper charge which, of course, reduces the likelihood that the molten copper will re-freeze within the hearth chamber 34 or within the tap hole 24. The splines 14 also minimize the tendency of the solid pieces in the charge to obstruct the burner outlets 40, thereby reducing the chances that the burners will become plugged or release excessive amounts of unreacted oxygen into the furnace 10. Similarly, the tap hole spline 60 helps to prevent solid pieces of the copper charge from becoming hung-up in the tap hole opening and possibly clogging the tap hole 24.

Still other advantages are associated with the floor stand-offs 20. For example, the floor stand-offs 20 help to prevent the solid pieces of copper from contacting the floor 18, which allows the hot combustion gases 36 from the lower row 42 of burners 22 to contact the floor 18, thus increasing its rate of heating, particularly during startup. The unobstructed floor 18 tends to promote faster and more complete melting of the copper charge, thus discouraging the tendency of the molten copper to re-freeze within the tap hole 24. Both the splines 14 and the stand-offs 20 also tend to increase the overall efficiency of the furnace 10 since more of the copper charge is in contact with the hot exhaust gases 36 from the burners 22 and/or the heat radiated from the hot refractory bricks 38, 48 lining the inner wall 16 and floor 18.

Having briefly described the improved shaft furnace 10 according to the present invention, as well as some of its more significant features and advantages, the shaft furnace 10 will now be described in detail.

Still referring to FIG. 2, the improved shaft furnace 10 according to the present invention is shown and described herein as it could be used to melt electrorefined or electrowon copper cathode in preparation for casting it in wirebar or continuous rod form. However, it should be understood that the improved shaft furnace 10 is not limited to the melting of copper cathode and could also be used in any of a wide variety of other melting and/or casting operations, as would be obvious to persons having ordinary skill in the art. Consequently, the present invention should not be regarded as limited to the particular application shown and described herein.

In accordance with its intended application, i.e., the melting and casting of copper cathode, the shaft furnace 10 may comprise an elongate, vertically oriented and cylindrically-shaped structure having a number of different segments or sections. Thus, in the embodiment shown in FIG. 2, the improved shaft furnace 10 may comprise, in order from the lowermost section upward, a hearth section 12, an intermediate or bosh section 26, a charging section 28, and a stack section 30.

Before proceeding with the description, it should be noted that persons having ordinary skill in the art will recognize that many of the structures and features of the shaft furnace 10 according to the present invention are similar to those found in currently available shaft furnaces for melting copper, such as those furnaces manufactured by ASARCO. For example, the intermediate section 26, the charging section 28, and the stack section 30 are generally similar to corresponding sections used in currently available shaft furnaces, and could be easily constructed by persons having ordinary skill in the art. However, the hearth section 12 of the improved shaft furnace 10 is not at all similar to the hearth sections used heretofore. Therefore, the following description will be directed primarily to the details of the hearth section 12, with those structures and features that are well-known described only generally.

Referring now to FIGS. 2 and 3 simultaneously, the hearth section 12 may comprise a generally cylindrically shaped structure having a side wall or inner wall 16 that, along with the floor 18, defines an open top chamber 34. In one preferred embodiment, the hearth section 12 may comprise, from the outside inward, a generally cylindrically shaped outer jacket 50 lined with a layer of concrete 52. The concrete layer 52 in turn may be lined with an intermediate layer 54 of refractory material, generally brick, although refractory materials in other forms could also be used. Finally, the intermediate layer 54 may be lined with a layer of refractory brick 38, which may comprise any of a wide range of refractory materials suitable for the intended application. By way of example, one preferred embodiment of the improved shaft furnace 10 utilizes an outer jacket 50 comprising steel and an intermediate layer 54 comprising silicon carbide bricks. The refractory bricks 38 comprising the inner wall 16 may also comprise silicon carbide.

The floor 18 of the hearth section 12 is similarly constructed and may comprise one or more layers of refractory brick 48 (FIG. 4) positioned over an intermediate refractory material (not shown) and/or a layer of concrete, as would be obvious to persons having ordinary skill in the art. Generally, it is preferred, but not required, that the floor 18 be inclined toward the tap hole 24 so that molten material (e.g., copper) will flow toward the tap hole 24. While a wide range of refractory materials may be used for the floor 18, one preferred embodiment uses a floor comprised of a plurality of silicon carbide bricks 48.

Referring now specifically to FIG. 3, the tap hole 24 may comprise a generally circular or rectangular opening 56 in the side or inner wall 16 of the hearth section 12. The tap hole 24 may be lined with one or more layers of refractory material in accordance with well-known practice. However, since tap holes for furnaces are well-known in the art and could be easily constructed by persons having ordinary skill in the art, the structure of the tap hole 24 will not be described in further detail.

The hearth section 12 also includes a plurality of burners 22 for filling the chamber 34 defined by the hearth section 12 with hot combustion gases 36 in sufficient quantity to heat not only the material charge but also the refractory bricks 38 and 48 lining the inner wall 16 and floor 18, respectively, to temperatures sufficient to melt the material charge. In the case of copper, which has a melting temperature of about 1983° F., it is usually desirable to heat and maintain the refractory bricks 38 and 48 at temperatures of about 2000° F. or above. Each burner 22 is oriented in a generally radial direction with respect to the central axis 58 of the hearth section 12, with the throat or outlet 40 of each burner 22 extending through the side wall 16 and being generally flush with the inner refractory brick 38. See FIG. 3.

In one preferred embodiment, the hearth section 12 may comprise three rows of burners 22, i.e., a lower row 42, an intermediate row 44, and an upper row 46 (FIG. 2). The burners 22 of each row may be offset radially with respect the other rows. For example, the burners 22 of the intermediate row 44 are offset radially with respect to the lower row 42, so that the outlets 40 of the intermediate row 44 are positioned generally above the beveled top surfaces 62 of the splines 14 and so that the outlets 40 of the lower row 42 of burners 22 are positioned generally between each spline 14. See FIG. 3. Alternatively, however, the burners 22 comprising the various rows 42, 44 and 46 may be generally aligned, as best seen in FIG. 2.

The exact number and placement of burners 22 will depend on the size (i.e., heat capacity) of the burners, the type of fuel to be used, and, of course, the capacity of the furnace 10. In one preferred embodiment, the lower row 42 comprises seven (7) individual burners 22, whereas the intermediate and top rows 44 and 46 comprise eight (8) burners 22 per row. Generally speaking, it will be desirable to utilize tunnel burners for each of the burners 22, since they minimize the likelihood that unconsumed oxygen will enter the chamber 34.

The burners 22 may comprise any of a wide range of commercially available burners suitable for the intended application, as would be obvious to persons having ordinary skill in the art. By way of example, one preferred embodiment of the present invention utilizes tunnel burners manufactured by Carborundum, Inc., of New Jersey and identified as model no. RL-2782-1 for the burners 22 comprising the bottom and intermediate rows 42 and 44 and as model no. RL-2782-2 for the burners 22 comprising the top row 46.

As mentioned above, the type of fuel burned by the burners should be selected to avoid contaminating the material being melted. For example, when copper is being melted, it is generally desirable to burn a fuel that is substantially free of sulfur, such as sulfur-free natural gas, propane, methane, butane or naphtha. In one preferred embodiment, the fuel used by the burners 22 comprises natural gas.

The fuel and oxidizer control systems (not shown) used to feed fuel and oxidizer to the burners 22 may likewise comprise any of a wide range of devices and systems that are readily commercially available for such uses. In one preferred embodiment, the fuel/oxidizer control system is manufactured by Trane Corporation as model no. 03-01-052-C-10, although other devices and systems may be used as well.

Figure 5:
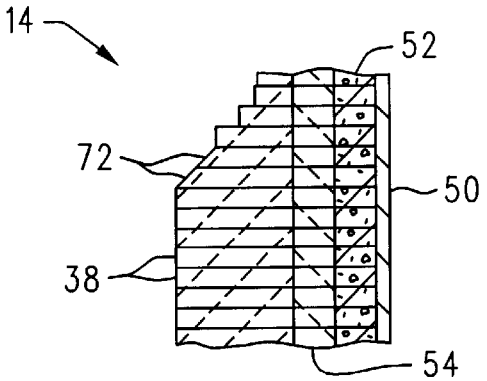
FIG. 5 is a cross-section of one of the splines taken along the line 5—5 of FIG. 4.

As was described above, the splines 14 and stand-offs 20 are critical in achieving the objects of the invention and will now be described in detail. Referring now to FIGS. 3, 4, and 5, a plurality of splines 14 are attached to the inner wall 16 of the hearth section 12 and extend generally upward from the floor 18. It is preferred, but not required, that the splines 14 be generally evenly radially spaced around the inner wall 16 of the hearth section 12, as best seen FIG. 4. The plurality of splines 14 may also include a tap hole spline 60 positioned over the tap hole 24.

With the exception of the tap hole spline 60, each spline 14 is essentially identical and may comprise an elongate, rectangularly shaped structure extending generally upward from the floor 18. Each spline 14 includes a beveled top surface 62, a pair of sides 64, 66, and a front surface 68. The tap hole spline 60 extends down to the tap hole 24, thus includes a bottom surface 70. See FIG. 3. Each spline 14 extends into the chamber 34 by a radial distance 72, as best seen in FIG. 4. For good performance, the radial distance 72 should be between about 2.5% and 5% of the chamber diameter 74, with the preferred radial distance 72 being about 3.75% of the chamber diameter 74. By way of example, for a hearth section 12 having a chamber diameter of 54 inches, the radial distance 72 of the splines should be between about 1.35 inches and 2.7, with a radial distance 72 of about 2 inches being preferred (i.e., each spline 14 extends into the chamber 34 by a distance of about 2 inches). The tap hole spline 60 is essentially identical to the other splines 14, except that it may be of shortened length to accommodate the tap hole 24. See FIG. 3.

In the case where the inner wall 16 comprises a plurality of refractory bricks 38, the splines 16 may be fabricated by extending the bricks 38 into the chamber 34, as best seen in FIG. 5. More specifically, the splines 14 may be formed by extending the appropriate courses of brick 38 inward by the radial distance 72. The top two courses 76 of brick 38 may be beveled to form the beveled top surface 62, as best seen in FIGS. 3 and 5.

Referring now to FIGS. 3 and 4, the floor 18 may likewise comprise a generally flat, though slanted, surface comprised of a plurality of refractory floor bricks 48. The stand-offs 20 may be formed by the use of additional bricks, so that the stand-offs 20 extend into the chamber 34 by a height 78. The width 80 and length 82 (FIG. 4) of each stand-off 20 is not particularly critical, and a wide range of widths and lengths may be used without departing from the spirit and scope of the present invention. By way of example, in one preferred embodiment the width 80 of each stand-off is about 6 inches while the length 82 is also 6 inches. The height 78 (FIG. 3) of each stand-off 20 is selected to be about 3 inches.

As was mentioned above, the inner wall 16 of the hearth section 12 is substantially vertical and defines a substantially cylindrical chamber 34. However, another embodiment of the invention may comprise a hearth section having a tapered inner wall, as best seen in FIG. 1, in which case the chamber defined thereby would be substantially conical. In that event, a plurality of splines may be provided in the manner already described, i.e., by extending the appropriate brick courses into the chamber to form the splines. Of course, a plurality of stand-offs could be provided in the floor of such a tapered chamber in an identical manner to that described for the floor 18 of the cylindrical chamber 34.

Referring back now to FIG. 2, the intermediate section or bosh 26, the charging section 28, and the stack section 30 may be of conventional construction, e.g., brick lined steel and concrete, and/or water cooled sections. However, since the construction of such shaft furnace sections is well-known and would be obvious to persons having ordinary skill in the art, the intermediate, charging, and stack sections 26, 28, and 30 will not be described in further detail.

The improved shaft furnace 10 may be used to melt any of a wide variety of materials, such as copper, aluminum, etc., for casting into any of a wide range of convenient final forms. In the embodiment shown and described herein, the improved shaft furnace 10 may be used to melt a charge of copper cathode in preparation for the casting of the same in wirebar or continuous rod form. In such an application, the furnace 10 may be filled with a suitable charge of copper cathode (not shown in FIG. 2, but shown generally in FIG. 1) by loading the charge into the furnace 10 through the opening 84 in the charging section 28. Any of a wide variety of charging systems (not shown) well-known in the art, such as a conveyer system, may be used to charge the furnace 10. The charging operation may be performed both before furnace start-up, as well as periodically during continuous furnace operation, depending on whether the furnace 10 is to be used in a batch process mode or a continuous process mode.

If the furnace is charged before start-up, the burners 22 may be ignited after the furnace 10 has been fully charged. Advantageously, the splines 14 and the stand-offs 20 help to hold the various pieces of the copper charge away from the refractory brick 38, 48 comprising the inner wall 16 and floor 18, respectively. The separation provided by the splines 14 and stand-offs 20 allows the hot combustion gases 36 from the burners 22 to contact a larger percentage of the refractory brick 38, 48 which results in increased heating rates and allows the refractory bricks 38, 48 to reach suitable operating temperatures much more rapidly than in prior art furnace designs. The splines 14 and stand-offs 20 also aid in the efficient and quick heating of the copper charge, since more of the same is also directly exposed to the hot combustion gases 36 from the burners 22.

After the hearth section 12 reaches operating temperature, about 2,000° F. in the case of copper, the copper charge (not shown) will begin to melt, collecting on the floor 18 and flowing out through the tap hole 24 into a suitable holding furnace (not shown). Since not all of the copper charge melts at the same time, the splines 14 and stand-offs 20 continue to perform the function of preventing the solid pieces from contacting the inner wall 16 and bottom 18 of the hearth section 12, thereby reducing the likelihood that the copper will melt, but then re-freeze in the tap hole 24 or elsewhere. The splines 14 also help to keep solid pieces away from the throats 40 of the burners 22, as best seen in FIG. 3, thereby significantly reducing the chances of obstructing or plugging the burners 22.

If continuous operation is desired, the furnace 10 may be periodically or continuously charged with copper cathode by the charging system (not shown) adjacent the opening 84 in the charging section 28. Here again, the splines 14 and stand-offs 20 will help to prevent solid pieces of copper from plugging the tap hole 24 or burner openings 40.

This completes the detailed description of the preferred embodiments of the improved shaft furnace 10 according to the present invention. While a number of specific components were described above for the preferred embodiments of this invention, persons skilled in this art will readily recognize that other substitute components or combinations of components may be available now or in the future to accomplish comparable functions to the apparatus described herein. For example, while the present invention discloses a shaft furnace 10 for use in the melting of copper cathode, it may be used to melt other metals and/or metal alloys that are commonly melted in shaft furnaces of the type generally described herein. Likewise, the present invention should not be regarded as limited to the particular size and arrangement of the splines 14 and stand-offs 20 shown and described herein. Indeed, since the primary function of the splines 14 and stand-offs 20 is to help to hold the solid pieces of the copper charge away from the refractory brick 38, 48 lining the inner wall 16 and floor 18, persons having ordinary skill in the art will recognize that a wide range of configurations for the splines 14 and stand-offs 20 would be possible without departing from the spirit and scope of the present invention.

Still other modifications are possible. For example, while the splines 14 and stand-offs 20 are constructed from bricks of silicon carbide, other refractory materials are available and could be substituted for the silicon carbide bricks shown and described herein. Likewise, with suitable modifications to dimensions and/or scale, the structural features associated with the improved shaft furnace 10 shown and described herein could also be incorporated in furnaces of larger or smaller capacities. Such modifications of dimensions and/or scale would be obvious to persons having ordinary skill in the art after having become familiar with the teachings of the present invention.

In sum, then, it is contemplated that the inventive concepts herein described may be variously otherwise embodied and it is intended that the appended claims be construed to include alternative embodiments of the invention except insofar as limited by the prior art.

What is claimed is:

1. An improved hearth section for a shaft furnace, the hearth section having a floor, a side wall, and a tap hole, wherein the side wall extends generally upward from the floor so that the floor and side wall define a chamber, and wherein the tap hole extends through the side wall, comprising:

a plurality of splines mounted to the side wall of the hearth section in spaced-apart circumferential positions, each of said plurality of splines extending radially inward from the side-wall into the chamber, wherein the chamber has a substantially circular cross-section at about the axial location of said plurality of splines and includes a chamber diameter, and wherein each of said plurality of splines extends into the chamber by a radial distance being between a minimum of about 2.5% of the chamber diameter and a maximum of about 5% of the chamber diameter; and a plurality of stand-offs mounted to the floor of the hearth section in generally spaced-apart relation, each of said plurality of stand-offs extending generally upward from the floor and into the chamber, wherein each of said plurality of stand-offs extends in to the chamber by a height of about 3 inches.

2. The improved hearth section of claim 1, wherein each of said plurality of splines has a beveled top surface.

3. The improved hearth section of claim 2, wherein at least one of the plurality of splines is positioned over the tap hole.

4. The improved hearth section of claim 3, wherein the hearth section includes a plurality of burners arranged generally radially around the hearth section and wherein said plurality of burners are also arranged in a plurality of axial rows including at least a first row of burners and a second row of burners, said first row of burners being located adjacent the floor and said second row of burners being located a spaced distance above said first row of burners, and wherein said plurality of splines are located at circumferential positions generally between said first row of burners.

5. The improved hearth section of claim 4, wherein said plurality of splines are located at circumferential positions generally aligned with said second row of burners.

6. The improved hearth section of claim 4, wherein the side wall and the floor of the hearth section comprise a plurality of refractory bricks and wherein each of said plurality of splines and each of said plurality of stand-offs comprises refractory bricks.

7. The improved hearth section of claim 6, wherein the side wall comprises an interior surface and an exterior surface and wherein the interior surface is generally cylindrical so that the chamber is substantially cylindrical.

8. The improved hearth section of claim 6, wherein the side wall comprises and interior surface and an exterior surface and wherein the interior surface is generally tapered outward in a direction upward from the floor so that the chamber is substantially conical.

9. The improved hearth section of claim 6, wherein said refractory brick comprises silicon carbide.

10. A shaft furnace, comprising:

a hearth section having a floor, a side wall, and a tap hole, wherein the side wall extends generally upward from the floor so that the floor and side wall define an open top chamber, and wherein the tap hole extends through the side wall;

a plurality of splines mounted to the side wall of said hearth section in generally spaced-apart relation, each of said plurality of splines extending radially inward from the side-wall and into the chamber, wherein the chamber has a substantially circular cross-section at about the axial location of said plurality of splines and includes a chamber diameter, and wherein each of said plurality of splines extends into the chamber by a radial distance being between a minimum of about 2.5% of the chamber diameter and a maximum of about 5% of the chamber diameter;

a plurality of stands-offs mounted to the floor of said hearth section in generally spaced-apart relation, each of said plurality of stand-offs extending generally upward from the floor and into the chamber, wherein each of said plurality of stand-offs extend into the chamber by a height of about 3 inches;

a burner operatively associated with said hearth section for providing hot combustion gases to the chamber;

a charging section having a side wall and extending generally upward from said hearth section, the side wall of said charging section also including an opening therein for receiving a charge of material to be melted; and a stack section extending generally upward from said charging section.

11. The shaft furnace of claim 10, wherein said burner comprises a plurality of burners arranged generally radially around said hearth section and wherein said plurality of burners are also arranged in a plurality of axial rows including at least a first row of burners and a second row of burners, said first row of burners being located adjacent the floor and said second row of burners being located a spaced distance above said first row of burners, and wherein said plurality of splines are located at circumferential positions generally between said first row of burners.

12. The shaft furnace of claim 11, wherein said plurality of splines are located at circumferential positions generally aligned with said second row of burners.

13. The shaft furnace of claim 11, wherein each of said plurality of splines has a beveled top surface.

14. The shaft furnace of claim 13, wherein at least one of said plurality of splines is positioned over the tap hole.

15. The shaft furnace of claim 14, further comprising a bosh section having a side wall extending between said hearth section and said charging section.

16. The shaft furnace of claim 15, wherein the side wall and the floor of said hearth section comprise a plurality of refractory bricks and wherein each of said plurality of splines and each of said plurality of stand-offs comprises refractory bricks.

17. The shaft furnace of claim 16, wherein the side wall of said hearth section comprises an interior surface and an exterior surface and wherein the interior surface is generally cylindrical so that the chamber is substantially cylindrical.

18. The shaft furnace of claim 16, wherein the side wall of said hearth section comprises and interior surface and an exterior surface and wherein the interior surface is generally tapered outward in a direction upward from the floor so that the chamber is substantially conical.

19. The shaft furnace of claim 16, wherein said refractory brick comprises silicon carbide.

20. The shaft furnace of claim 16, wherein the floor of said hearth section is slanted toward the tap hole.

21. A shaft furnace, comprising:

a hearth section having a floor, a side wall, and a tap hole, the side wall extending generally upward from the floor so that the floor and side wall define an open top chamber, wherein the tap hole extends through the side wall and wherein the floor is slanted toward the tap hole;

a plurality of burners arranged generally radially around said hearth section and wherein said plurality of burners are also arranged in a plurality of axial rows including at least a first row of burners and a second row of burners, said first row of burners being located adjacent the floor and said second row of burners being located a spaced distance above said first row of burners;

a plurality of splines mounted to the side wall of said hearth section in generally spaced-apart relation and at axial positions generally between said first row of burners, each of said plurality of splines extending radially inward from the side wall and into the chamber, wherein each of said plurality of splines has a beveled top surface, wherein the chamber has a substantially circular cross-section at about the axial location of said plurality of splines and includes chamber diameter, and wherein each of said plurality of splines extends into the chamber by a radial distance being between a minimum of about 2.5% of the chamber diameter and a maximum of about 5% of the chamber diameter;

a plurality of stands-offs mounted to the floor of said hearth section ins generally spaced-apart relation, each of said plurality of stand-offs extending generally upward from the floor and into the chamber, wherein each of said plurality of stand-offs extends into the chamber by a height of about 3 inches;

a charging section having a side wall and extending generally upward from said hearth section, the side wall of said charging section also including an opening therein for receiving a charge of material to be melted; and a stack section extending generally upward from said charging section.

22. A method for melting a charge of material, comprising the steps of:

placing the charge of material into a shaft furnace, the shaft furnace including a hearth section having a floor, a side wall, and a tap hole, wherein the side wall extends generally upward from the floor so that the floor and side wall define a chamber, and wherein the tap hole extends through the side wall, the hearth section also including a plurality of splines mounted to the side wall in generally spaced-apart relation so that each of the plurality of splines extends generally radially inward from the side-wall and into the chamber, wherein the chamber has a substantially circular cross-section at about the axial location of said plurality of splines and includes a chamber diameter, and wherein each of said plurality of splines extends into the chamber by a radial distance being between a minimum of about 2.5% of the chamber diameter and a maximum of about 5% of the chamber diameter, and a plurality of stand-offs mounted to the floor in generally spaced-apart relation so that each of the plurality of stand-offs extends generally upward from the floor and into the chamber, wherein each of said plurality of stand-offs extends into the chamber by a height of about 3 inches;

introducing hot combustion gases into the hearth section, wherein said hot combustion gases provide sufficient heat to melt the charge of material; and drawing off melted material through the tap hole.

23. A hearth section for a shaft furnace, comprising:

a side wall enclosing an interior chamber, said side wall including a plurality of burner openings therein for injecting heat into the interior chamber and a tap hole therein for drawing-off molten material;

a plurality of splines extending radially inward from said side wall, wherein said plurality of splines are located at spaced-apart circumferential positions around said side wall and wherein at least one of the plurality of splines is positioned over the tap hole, wherein the chamber has a substantially circular cross-section at about the axial location of said plurality of splines and includes a chamber diameter, and wherein each of said plurality of splines extends into the chamber by a radial distance being between a minimum of about 2.5% of the chamber diameter and a maximum of about 5% of the chamber diameter;

a substantially planar floor located at a lower end of said side wall, said substantially planar floor defining a bottom of the interior chamber and being sloped form a high point adjacent the side wall to a low point adjacent the tap hole; and a plurality of stands-off extending generally upward from the floor, wherein each of said plurality of stands-offs extends into the chamber by a height of about 3 inches.

24. The hearth section of claim 23, wherein the burner openings in said side wall comprise a lower row of burner openings and an upper row of burner openings and wherein said plurality of splines are located at circumferential positions that are substantially between the lower row of burner openings so that each burner opening in the lower row of burner openings is located between adjacent splines.

25. The hearth section of claim 24, wherein the upper row of burner openings are spaced around said side wall so that each burner opening in the upper row of burner openings is generally aligned with each of said plurality of splines.

26. The hearth section of claim 25 wherein each of said plurality of splines comprises a beveled top surface.

27. A hearth section for a shaft furnace, comprising:

a side wall having a substantially circular cross-section for enclosing an interior chamber having a chamber diameter, said side wall including a plurality of burner openings therein for injecting heat into tube interior chamber and a tap hole therein for drawing-off molten material;

a plurality of splines having generally rectangular cross-sections extending radially inward from said side wall by a radial distance that is between a minimum of about 2.5% of the chamber diameter and a maximum of about 5% of the chamber diameter, wherein said plurality of splines are located at space-apart circumferential positions around said side wall and wherein at least one of the plurality of splines is positioned over the tap hole;

a substantially planar floor located at a lower end of said side wall, said substantially planar floor defining a bottom of the interior chamber and being sloped from a high point adjacent the side wall to a low point adjacent the tap hole; and a plurality of stand-offs extending generally upward from the floor, wherein each of said plurality of stand-offs extends into the chamber by a height of about 3 inches.

* * * * *

UNITED STATES PATENT AND TRADEMARK OFFICE

CERTIFICATE OF CORRECTION

PATENT NO. : 5,890,889

DATED : April 6, 1999

INVENTOR(S) : Barstow

It is certified that error appears in the above-identified patent and that said Letters Patent is hereby corrected as shown below:

Column 7, (line 32), delete "upward from".

Column 7, (line 33), delete "the floor 18" and insert therefor --inwardly from the inner wall 16--.

IN THE CLAIMS

Column 10, (line 43), delete "and" and insert therefor --an--.

Column 11, (line 45), delete "and" and insert therefor --an--.

Column 12, (line 15), delete "ins" and insert therefor --in--.

Column 13, (line 8), delete "form" and insert therefor --from--.

Signed and Sealed this

Fourteenth Day of September, 1999

*Attest:*

Q. TODD DICKINSON

*Attesting Officer*

*Acting Commissioner of Patents and Trademarks*